US009186002B2

(12) United States Patent
Fan

(10) Patent No.: US 9,186,002 B2
(45) Date of Patent: Nov. 17, 2015

(54) FILLED BEDDING ARTICLES CONSISTING OF MORE THAN ONE FILLER

(71) Applicant: Pac-Fung Feather Co., Ltd., Kowloon (HK)

(72) Inventor: Shi Hoo Fan, Kowloon (HK)

(73) Assignee: PAC-FUNG FEATHER CO., LTD., Kowloon (HK)

( * ) Notice: Subject to any disclaimer, the term of this patent is extended or adjusted under 35 U.S.C. 154(b) by 0 days.

(21) Appl. No.: 13/926,783

(22) Filed: Jun. 25, 2013

(65) Prior Publication Data

US 2014/0373277 A1 Dec. 25, 2014

(51) Int. Cl.
*A47G 9/02* (2006.01)
*A47G 9/00* (2006.01)

(52) U.S. Cl.
CPC ..... *A47G 9/0207* (2013.01); *A47G 9/0223* (2013.01); *A47G 9/0238* (2013.01); *A47G 9/0215* (2013.01)

(58) Field of Classification Search
CPC ..... A47G 9/02; A47G 9/0207; A47G 9/0215; A47G 9/0223; A47G 9/023; A47G 9/0238
USPC ..... 5/502, 500, 486, 482
See application file for complete search history.

(56) References Cited

U.S. PATENT DOCUMENTS

| | | | | | |
|---|---|---|---|---|---|
| 2,248,768 | A * | 7/1941 | Licht | 5/485 |
| 2,544,797 | A * | 3/1951 | Lippmann | 5/502 |
| 3,508,284 | A | 4/1970 | Marquette | |
| 4,839,934 | A * | 6/1989 | Rojas | 5/502 |
| 5,007,125 | A | 4/1991 | Owenby | |
| 5,299,333 | A * | 4/1994 | Pedersen et al. | 5/502 |
| 5,408,712 | A * | 4/1995 | Brun | 5/502 |
| 5,708,995 | A | 1/1998 | Wu et al. | |
| 5,720,058 | A * | 2/1998 | Hollander et al. | 5/502 |
| 6,301,730 | B1 * | 10/2001 | Delfs et al. | 5/502 |
| 6,643,872 | B1 | 11/2003 | Buswell | |
| 6,957,465 | B1 * | 10/2005 | Oprandi | 5/727 |
| 6,961,970 | B2 * | 11/2005 | Pedersen | 5/502 |
| 7,356,863 | B2 * | 4/2008 | Oprandi | 5/691 |
| 7,356,864 | B1 * | 4/2008 | Delfs | 5/691 |
| 2005/0210586 | A1 * | 9/2005 | Pedersen | 5/502 |
| 2007/0113349 | A1 * | 5/2007 | Oprandi | 5/691 |
| 2014/0373277 | A1 * | 12/2014 | Fan | 5/502 |
| 2015/0013068 | A1 * | 1/2015 | Werthaiser | 5/502 |

* cited by examiner

*Primary Examiner* — Robert G Santos
(74) *Attorney, Agent, or Firm* — Leason Ellis LLP

(57) ABSTRACT

The present invention is directed to a bedding article which provides a structured construction for filling with filler material. Specifically, the present invention is directed to a bedding article that incorporates a number of pattern arrangements. The pattern arrangements allow for the sequestration of high performance filler material to areas of maximum effectiveness. Likewise, the pattern arrangement allows for standard performance material to be used in areas where user interaction is likely to be minimal, in order to minimize the amount of material needed in manufacture.

11 Claims, 5 Drawing Sheets

FILLED BEDDING ARTICLES CONSISTING OF MORE THAN ONE FILLER

FIELD OF THE INVENTION

The present invention is directed to a bedding article and construction that is applicable to a wide variety of bedding types. More particularly, the present invention is directed to a bedding article using a plurality of filler types to achieve maximum comfort with a minimal usage of expensive, high performance materials.

BACKGROUND OF THE INVENTION

Comforters are a bedding material typically used as accessories to the primary sheets placed on a bed. In the current art, comforters are usually filled or manufactured to include batting or another material that provides both comfort and warmth or heat retention functions. However, the prior art fails to provide a bedding material that provides specialized zones of warmth in a comforter.

Featherbeds have various sewing constructions, including a channel arrangement which runs the entire length or the entire width, i.e. from side to side, of the featherbed. Channel construction can also include baffles, which are fabric elements which extend between the top and bottom fabric layers of the featherbed within the individual channels. In general, the channel/baffle construction divides the featherbed geometrically into a pattern of rectangles.

Other sewing constructions used with featherbeds include stitch sewing, which can include various sewn patterns, such as squares, diamonds or other shapes, and which individually connected to the top and bottom fabric layers of the featherbed, but are not connected together to form a continuous or repeating pattern.

Frame construction for featherbeds comprises channels sewn along the outer sides and across the top and/or bottom of the featherbed. Frame construction can be combined with sewn patterns, if desired.

There are disadvantages to all of the above constructions. Channel construction without baffles, as well as stitch sewing and frame sewing, allow the feathers within the featherbed to readily move or shift within the featherbed during typical use. Feathers ordinarily will shift to the top (head) and/or bottom (foot) of the featherbed. The featherbed will as a result look uneven, and its heat retention and comfort will be compromised. While this can be remedied by fluffing and physically shifting the featherbed, this is often inconvenient to do on a daily basis.

With the baffle construction, which is the most popular sewing construction for featherbeds, the baffle squares have an opening which runs along one edge of the baffle fabric wall inside the featherbed to allow for filling (blowing-in) of the individual squares. This is well-known in the industry. However, these "blow holes" in the baffles remain open after the filling is completed (there is no convenient way of closing the openings) and feathers will eventually migrate out of the individual squares into adjacent ones during use of the featherbed. This results in an uneven look and diminished performance, which cannot be corrected by fluffing because the feathers cannot be forced back into the openings in the squares from which they have migrated.

Therefore, what is needed in the art is an article that allows for the retention of high performance materials in pre-designated zones, while lowering the cost of manufacture.

U.S. Pat. No. 5,708,995 to Wu, herein incorporated by reference, provides a comforter with different warmth characteristics for two occupants with a light side, a warm side, and a transitional area between, with specific stacked layers. U.S. Pat. No. 5,007,125 to Owenby, herein incorporated by reference, details a comforter which provides a warmer lower portion than the upper portion. U.S. Pat. No. 3,508,284 to Marquette, herein incorporated by reference, describes a comforter using a one-weave manufacturing process with two halves of different warmth characteristics for two occupants. However, none of the cited prior art providing all the features of the disclosed invention.

Likewise U.S. Pat. No. 6,643,872 to Buswell, introduces two halves of dual warmth to form a bedding article. However, this invention does not provide a solution that eliminates the need to use the maximum amount of bedding material. Additionally, U.S. Pat. No. 6,961,970 to Pedersen, introduces various embodiments of channel construction. However, this prior art reference fails to describe the use of limited selections of material so as to reduce overall product manufacturing costs.

SUMMARY OF THE INVENTION

It is an object of the present invention to provide a bedding article which provides a structured construction for filling with insulating material. Specifically, the present invention is directed to a bedding article that incorporates a number of pattern arrangements of the insulating material. These pattern arrangements allow for the sequestration of high performance filler material to areas of maximum effectiveness. Likewise, the pattern arrangement allows for standard performance material to be used in areas where user interaction with the bedding article is likely to be minimal.

In one particular embodiment of the present invention, a bedding article is provided with a U-shaped filling channel. The bedding material is formed such that a central portion is segregated from the U-shaped perimeter. As such, the present invention provides for a material that has differing performance characteristics depending on the specific area of the article used. For example, the present invention provides for a central high warmth retention, high volume material area in contact with the user while sleeping, and a low thermal retention, low volume border area spaced from the user's body while sleeping.

BRIEF DESCRIPTION OF THE DRAWINGS

The foregoing and other features of the present invention will be more readily apparent from the following detailed description and drawings of an exemplary arrangement of the elements of the device described in which.

DETAILED DESCRIPTION OF THE INVENTION

By way of overview and introduction, the present invention is directed to a bedding article configurable to have separate performance areas that incorporate different materials designed to lower the overall manufacturing cost of the article, while maintaining the desired functional characteristics.

Those skilled in the art will appreciate that the present bedding article can be applied to various forms such as comforters, sheets, pillows, cushions, blankets, featherbeds, mattress pads and the like.

Figure 1:
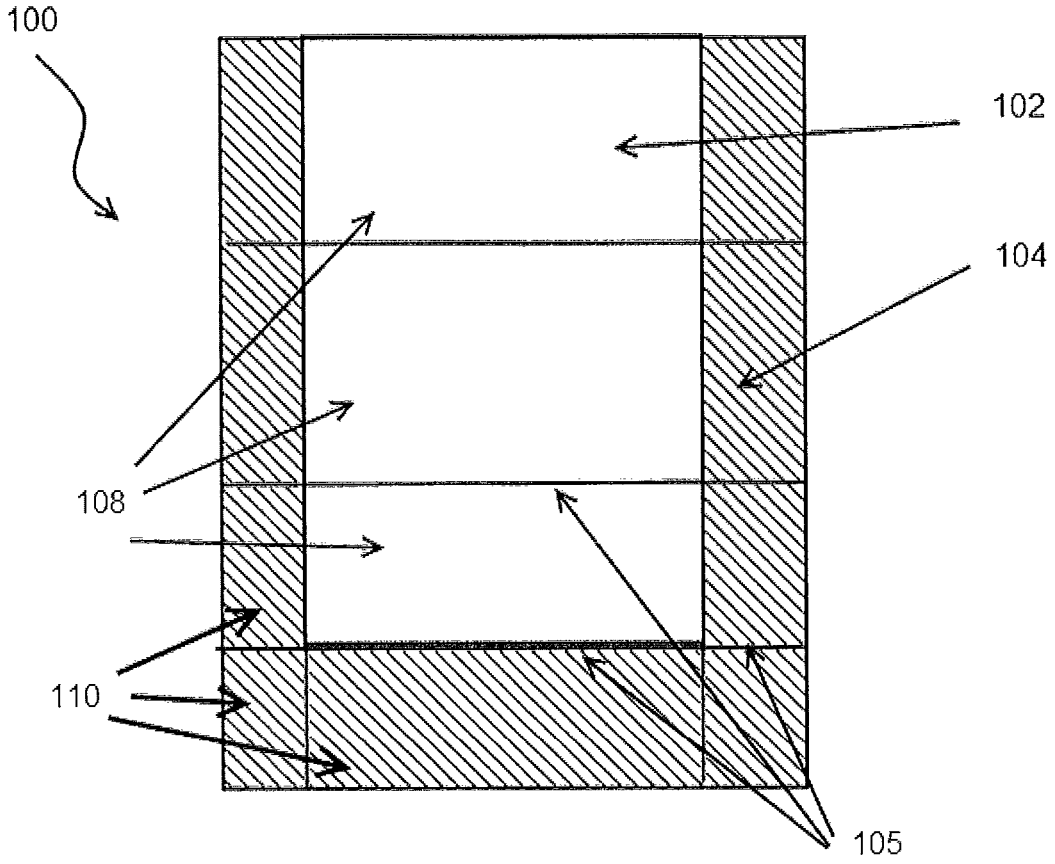
FIG. 1 illustrates a top view of a particular embodiment of the bedding article according to the present invention with a central heat retention area.

As seen in FIG. 1, a bedding article 100 is provided. Those skilled in the art will appreciate that the depicted article is a comforter or sheet provided with an internal filler to provide comfort and warmth to the user.

In the present construction, the bedding article 100 is formed of a top sheet and a bottom sheet. In the envisioned configuration, the two material sheets are joined by sewing, quilting or stitching 105. In the illustrated construction, the bedding is formed such that a plurality of independent cells is provided in a high usage area 102. In the depicted embodiment, the high usage area 102 is the center of the bedding article 100, and bisects the bedding article.

Those skilled in the art will appreciate that the present invention envisions that high use area 102 is variable in positioning, and is not restricted to the center of the sheet. Through the use of quilting, stitching or a similar fastening mechanism 105, each of the plurality of cells is configured to prevent the migration of material from one cell to another. In the depicted embodiment, each cell is filled with a filler material prior to the securing the top sheet to the bottom sheet. However, those skilled in the art will appreciate that various filling and securing methods are envisioned and contemplated.

In the illustrated arrangement, the high usage area 102 of the bedding article 100 is constructed to contain premium quality filler materials 108. This material 108 has high heat retention properties and is soft. However, it also tends to be expensive.

The filler of the present invention can be wool, cotton, silk, batting, microfiber, synthetic and natural fibers, wadding and similar standard filling materials. Those skilled in the art would appreciate that premium filler materials can include variations and variants of the standard filler than has been specially modified or constructed for the purposes of improved comfort, heat retention or functionality. For instance, premium filler is envisioned but not limited to memory foam, visco-elastic materials, natural feathering and products, as well as similar textile materials.

The perimeter of the bedding article forms a low use area 104. In the depicted embodiment, the low use areas 104 are positioned where there is low user interaction. For example, in the illustrated embodiment, the low usage area 104 is positioned at the edges of the bedding article 100 where a person sleeping in a bed and covered with the bedding article will not typically have their body in contact with the low use area as compared to the high use area 102. The individual cells comprising the low usage areas 104 are filled with standard filler material 110 (shown as slanted vertical lines). In this respect, standard filler material 110 is of lower quality, performance and cost than premium quality material 108. However, those skilled in the art will recognize that the standard and premium fillers are relative to one another. Thus, it is envisioned that one objectively high quality filler material, such as Down, is secured in the low usage area, while a different, superior material, is secured in the high usage area 102.

Through this arrangement, the user is afforded a premium material that is sufficient to provide the desired comfort, without the added cost of providing additional premium material to areas not often used by the user.

In the depicted figure, the bedding article consists of at least two different types of filling materials. However, those skilled in the art will recognize that multiple types of fillers are envisioned in the material. For example, in an alternative arrangement, the present invention provides for at least two different premium filler materials in alternating cells of the high usage area 102.

Figure 2:
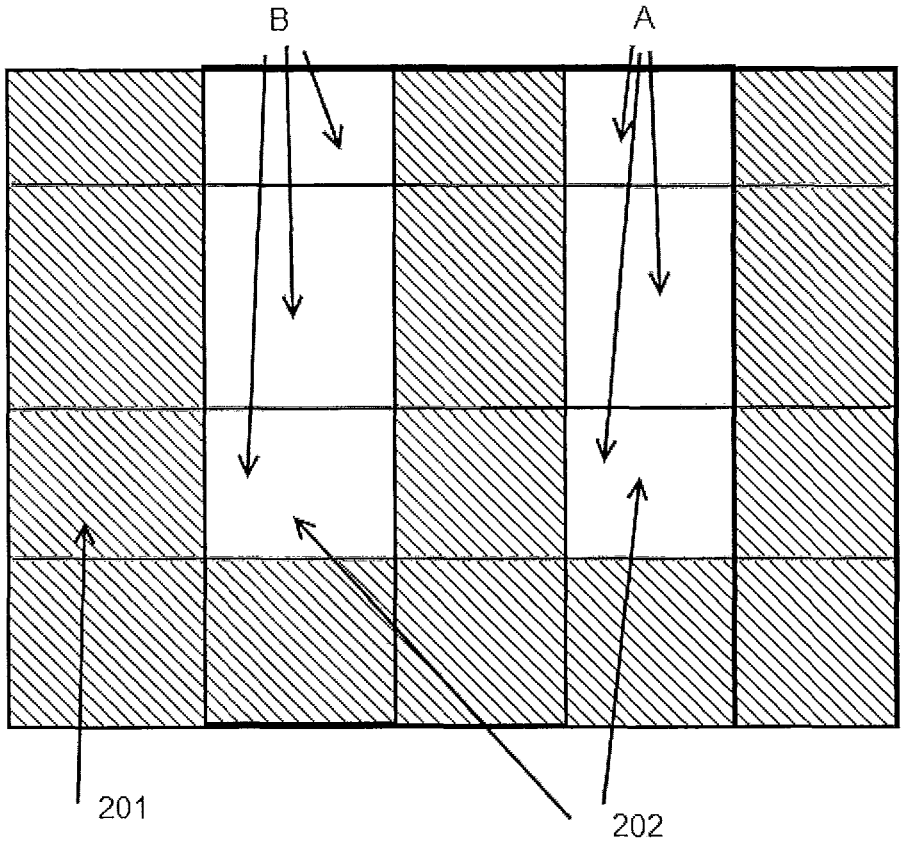
FIG. 2 illustrates an alternative embodiment of the bedding article according to the present invention of FIG. 1 with two spaced central heat retention areas.

In FIG. 2, an alternative embodiment of the present invention is provided. In the illustrated arrangement, at least two sections 202 of the high usage area are depicted. Both of the illustrated high use sections 202 contain premium filler. For example, each of the cells of the high use areas 202 contain premium type filler A or/and B. As shown, the center portion is configured as a low usage area, which allows for the segregation of distinct zones. For example, in the illustrated embodiment, one section is filled with high warmth retention materials (A), while the other high use section is filled with high density cooling material (B). Thus, in this configuration, the user is provided with at least two distinct region of a given characteristic. For example, the present invention is configured such that two users of the same bedding article are equally covered by premium materials, but with different desired characteristics. As such, well defined zones for the users are maintained so that one can enjoy high heat retention and the other can enjoy a cooler environment. The center section between sections 202 is filled with lower cost standard material, because it represents the area between the two users, so it does not have to have desired characteristics.

In an alternative arrangement, each of the premium filled cells is configured with a different combination of premium product. For example, premium filled column A is secured with Down-like material, while column B is secured with Down and foam. In this way the present arrangement provides two different regions of premium functionality. In both described configurations, the border 201 is composed of cells filled with standard quality material. In this configuration, the users are covered with premium high performance material, while the areas not typically used for sleeping are filled with standard filler material 110.

Furthermore, those skilled in the art will appreciate that the size of the cells is variable, such that the high usage and low usage portions are of any given dimension. For example, the in one arrangement, the high usage area is a given, standard, bedding dimension (e.g. King, Queen, Full, Twin), while the low usage portion forms a border around that region.

Figure 3:
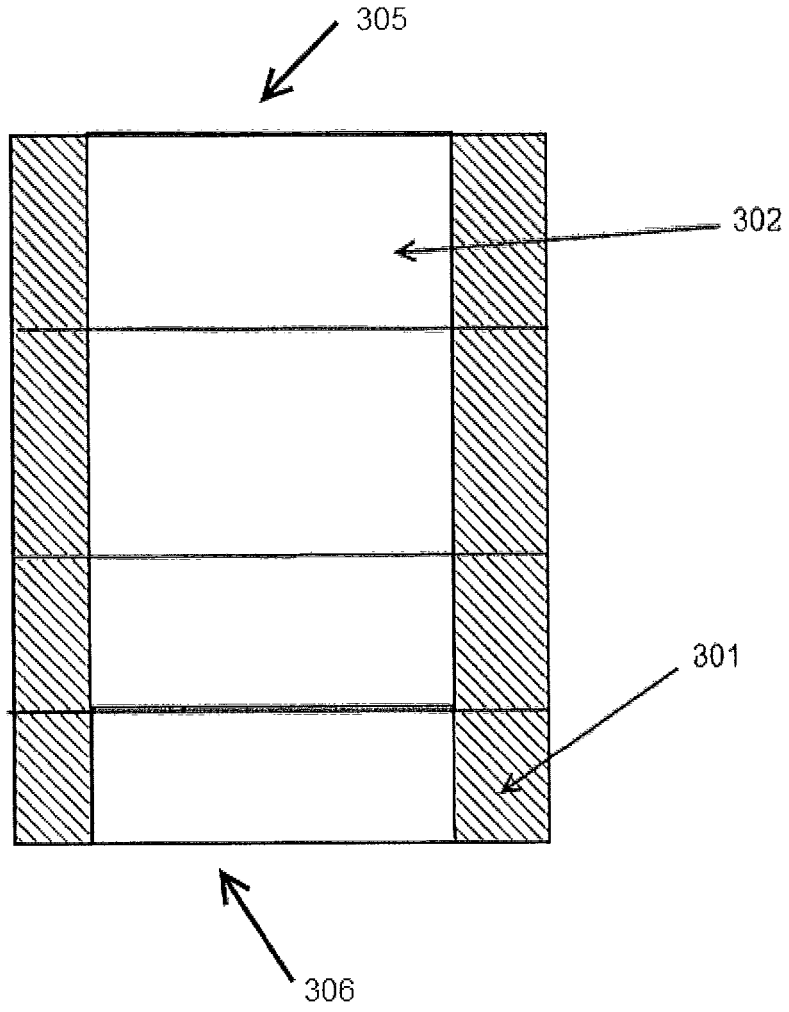
FIG. 3 illustrates a top view of an alternative embodiment of the bedding article according to the present invention with a central heat retention area that extends from the head to the foot of the bedding article.

Those skilled in the art will also appreciate that the present invention is not limited to a particular size of the high usage area relative to the total dimensions of the bedding article. Additionally, the high usage areas are configurable as horizontal bands spanning the width of the bedding, as opposed to the vertical height of the bedding article. In one embodiment, the premium cells consist of substantially all of the usable area of the bedding article As seen in FIG. 3, the present invention also incorporates a channel filling configuration. In this embodiment the filled bedding material is filled such that the high usage portion 302 of the bedding article runs the length of the bedding article from the head 305 to the foot 306, and is filled with high performance material. Conversely, the low usage areas 301 of the bedding article are filled with standard material. In this arrangement, there is no bordering around the top and bottom portions of the high usage area 302.

Figure 4:
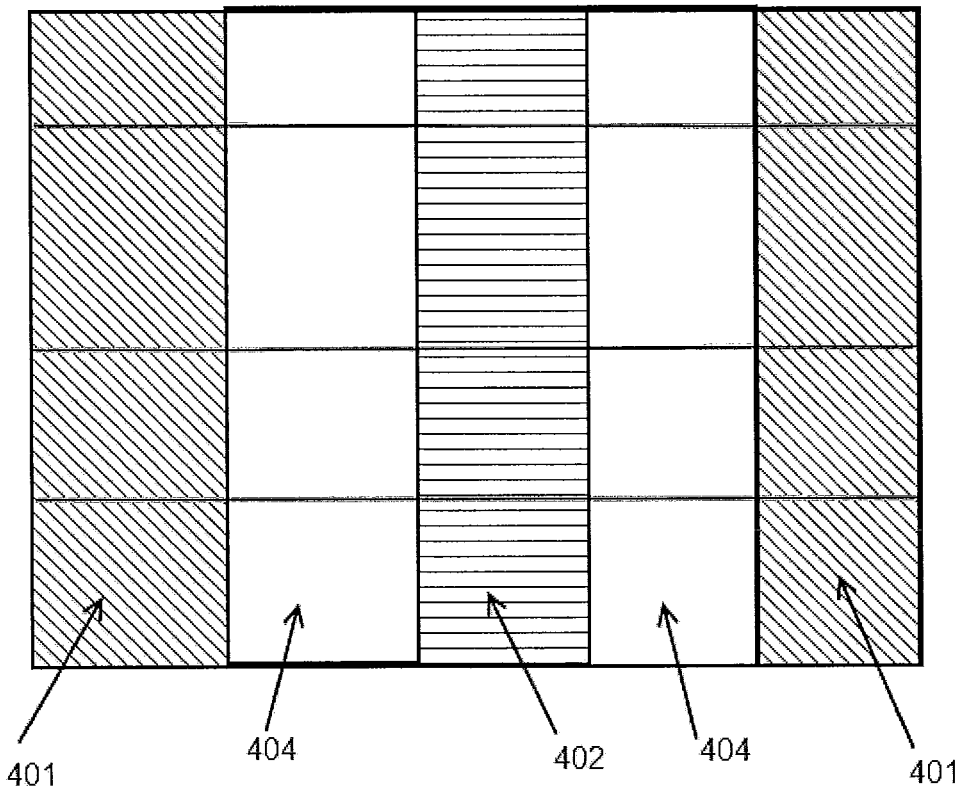
FIG. 4 illustrates an alternative embodiment of the bedding article according to the present invention of FIG. 3.

As seen in FIG. 4, the bedding article of the present invention also provides for gradient filling. In the depicted embodiment the outer columns (low use area) 401 are filled with standard material. The inner columns (high use are) 404 are filled with premium material. However, in this configuration, a singular central column 402 is provided. In one arrangement, this center column 402 is filled with a premium or standard material. In the alternative, the center column 402 is filled with standard material. In yet a further embodiment, the center column is not filled with any material and is composed of empty cells.

Figure 5:
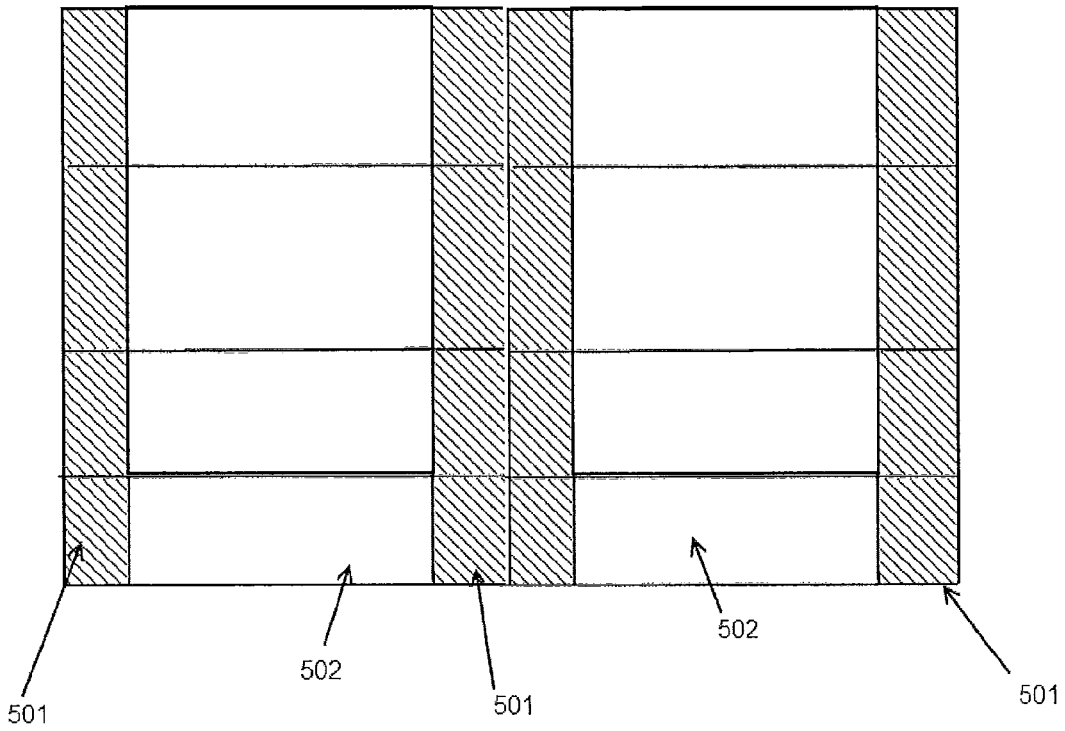
FIG. 5 illustrates an alternative embodiment of the bedding article according to the present invention which is similar to FIG. 4, but is wider.

As seen in FIG. 5, the bedding article is also configured to incorporate a number of different arrangements or patterns, depending on the anticipated use or preference or the user or manufacturer. For example, the illustrated embodiment provides for an outer column and central column 501 filled with one form of premium material, and inner columns filled with an alternative premium material 502.

It should be understood that various combinations, alternatives and modifications of the present invention could be devised by those skilled in the art. The present invention is intended to embrace all such alternatives, modifications and variances that fall within the scope of the appended claims.

While the invention has been particularly shown and described with reference to a preferred embodiment thereof, it will be understood by those skilled in the art that various changes in form and details may be made therein without departing from the spirit and scope of the invention.

I claim:

1. A bedding article comprising;

a top material sheet, a bottom material sheet, wherein the top sheet and the bottom sheet are joined so as to produce a plurality of enclosed cells;

wherein at least a portion of the enclosed cells are filled with a premium bedding material and the remaining portion of the cells is filled with a standard bedding material and each cell is configured to prevent the migration of bedding material from one cell to another;

wherein contents of the enclosed cells alternate between cells filled with a standard bedding material type and cells filled with a premium bedding material type such that at least one cell filled with a standard bedding material type is interposed between two cells filled with a premium bedding material type.

2. The bedding article as recited in claim 1, wherein;

the plurality of premium bedding material filled cells are located in the center of the bedding article.

3. The bedding article as recited in claim 1, wherein;

the top and bottom sheet are joined by at least one of stitching, quilting or clasping devices.

4. The bedding article as recited in claim 1, wherein;

the premium bedding material is comprised of a material having increased thermal retention properties relative to the standard bedding material.

5. The bedding article as recited in claim 1, wherein each premium bedding material is selected from a high warmth retention bedding material or a cooling bedding material.

6. The bedding article as recited in claim 5 further including a band of cells with standard bedding material located between the cells filled with premium thermal retention material and cells filled with premium cooling material.

7. The bedding article as recited in claim 2, wherein the standard bedding material is located on both sides and at the foot of the sheets.

8. The bedding article as recited in claim 6, wherein there is a mixture of standard and premium bedding materials in a band bisecting the center of the bedding article.

9. A bedding article comprising;

a top material sheet, a bottom material sheet, wherein the top sheet and the bottom sheet are joined so as to produce a plurality of enclosed cells, wherein the cell are configured to prevent the migration of material between the cells; and wherein the cells provide an alternating pattern comprising at least two enclosed cells each containing a composition containing a mixture of at least a first type of premium bedding material and at least a second type of premium bedding material, and an enclosed cell containing a standard bedding material type interposed between the at least two enclosed cells each containing a mixture of at least a first type of premium bedding material and at least a second type of premium bedding material.

10. The bedding article as recited in claim 9, wherein;

the at least a first type premium bedding material and the at least a second type of premium bedding material include at least a premium bedding material having cooling properties.

11. The bedding article as recited in claim 9, wherein;

the at least a first type premium bedding material and the at least a second type of premium bedding material include at least a premium bedding material having heat retention properties.

* * * * *